US006109213A

United States Patent [19]

Rebalko

[11] Patent Number: 6,109,213

[45] Date of Patent: Aug. 29, 2000

[54] COMPETITIVE DOG PERFORMANCE APPARATUS AND METHOD

[76] Inventor: Lee Anton Rebalko, 5460 Godfrey Rd., Pompano Beach, Fla. 33067

[21] Appl. No.: 09/426,901

[22] Filed: Oct. 26, 1999

Related U.S. Application Data

[60] Provisional application No. 60/156,302, Sep. 24, 1999.

[51] Int. Cl.[7] ..... A63K 1/02

[52] U.S. Cl. ..... 119/422; 472/87; 119/705

[58] Field of Search ..... 119/422, 702, 119/705, 839; 472/87

[56] References Cited

U.S. PATENT DOCUMENTS

| | | | |
|---|---|---|---|
| 512,654 | 1/1894 | Leonard | 472/87 |
| 855,670 | 6/1907 | Roberts et al. | 472/87 |
| 1,717,135 | 6/1929 | Young | 472/87 |
| 1,755,676 | 4/1930 | Twiford et al. | 472/87 |
| 3,584,604 | 6/1971 | Wegner | 119/702 X |
| 4,323,034 | 4/1982 | Carlson | 119/705 |
| 4,619,222 | 10/1986 | Sundberg | 119/422 |
| 4,793,288 | 12/1988 | Hoadley | 119/705 |
| 5,586,520 | 12/1996 | Cleary | 119/705 |

*Primary Examiner*—Robert P. Swiatek
*Attorney, Agent, or Firm*—Alvin S. Blum

[57] ABSTRACT

A dog performance apparatus and method for competition trial runs has an enclosed area divided into a series of communicating passages forming an endless convoluted course that each dog must run. Distributed in series along the course are a number of obstacles the dog must traverse. The obstacles may include tunnels, jumps, apertured partitions, hurdles, A-frames, teeters, and constricting arches. A lure attached to an endless cord loop is remotely pulled along the course by a mechanism. Guides direct the lure through the course in such fashion as to encourage the dog to properly traverse the obstacles in the passage. The time the dog takes to make the run is measured.

10 Claims, 3 Drawing Sheets

COMPETITIVE DOG PERFORMANCE APPARATUS AND METHOD

This application is based upon Provisional Patent Application Serial No. 60/156,302 filed Sep. 24, 1999, incorporated herein by reference.

BACKGROUND OF THE INVENTION

This invention relates to competitive animal trial runs, and more specifically to apparatus and method for performing competitive trial runs for dogs through a course that combines racing over a closed course with running through various fixed obstacles on the course.

DESCRIPTION OF THE PRIOR ART

Lure coursing is a well known canine sporting event and trial event among enthusiasts. This is a sport that re-creates the chase of the hare by the pursuing hound. The lure simulating the hare is generally a white plastic bag that is attached to an endless loop of line that runs through a series of pulleys to define a zigzag course through an open field of at least five acres. The dogs are judged on speed, enthusiasm, endurance, and accuracy in following the course. Lure coursing is generally only used with breeds that hunt by sight such as Greyhounds, Afghans, Basenjis, Salukis, Whippets, Rhodesian Ridgebacks, and the like.

Another traditional event is "agility". This began as an exhibition sport in Great Britain, and was imported here in 1977. It was patterned after equestrian events and combines handler control, agility, and confidence. An agility ring is set up with a variety of obstacles. Obstacles include jumps, tunnels, a dog walk, a see-saw or teeter, an A-frame, and weaver poles. The ring is generally square, about 100×100 ft., and fenced off from the spectators. Dogs go through the ring on a leash with a handler (basic agility), or off leash with a guiding handler (advanced agility). They are judged by their ability to correctly negotiate the obstacles in a predetermined order. The dogs are judged primarily by the correctness by which they move on and off the obstacles and by which they stop and stay (on command) on other obstacles. The dogs are secondarily judged by their time in completing the obstacle course. This event requires significant training of both handler and dog.

SUMMARY OF THE INVENTION

The apparatus and method of the invention combine certain features of both the agility ring and lure coursing with modifications to provide a pleasant and novel event much enjoyed by participants and spectators. The course of the invention comprises a fenced track with an endless loop cord driven by a motor and guided by pulleys to define a tortuous path for a lure attached to the cord. The path includes a series of obstacles to be negotiated by the dog. The obstacles may include tunnels, jumps, holes in fences, hurdles, hay bales, A-frames, teeters, and the like to test the animal's balance, speed, agility, training, and endurance. It is not limited to any particular type or breed of dog. Obstacles can vary in order and type. It requires a much smaller area (usually about 5,000 feet) than the lure coursing event's 5 acres. The course's usual dimensions of about 100×35 feet may be easily modified to adapt to suitable sites, particularly in urban areas. A timing mechanism is included to indicate the time the animal took to complete the course. The apparatus is constructed to be easily erected, disassembled, and transported for use at various events at different locations. Whereas the agility ring uses no lure, because the handler guides the dog, the apparatus of the invention employs a lure that traverses the obstacles in such a manner as to encourage and guide the dog through the obstacles without the need for a trained handler. The speed of the lure, controlled remotely by the lure operator, ensures that the dog will move through the course at a pace controlled by the lure speed. It is an object of the invention to train the dog without a handler to overcome obstacles in its path. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
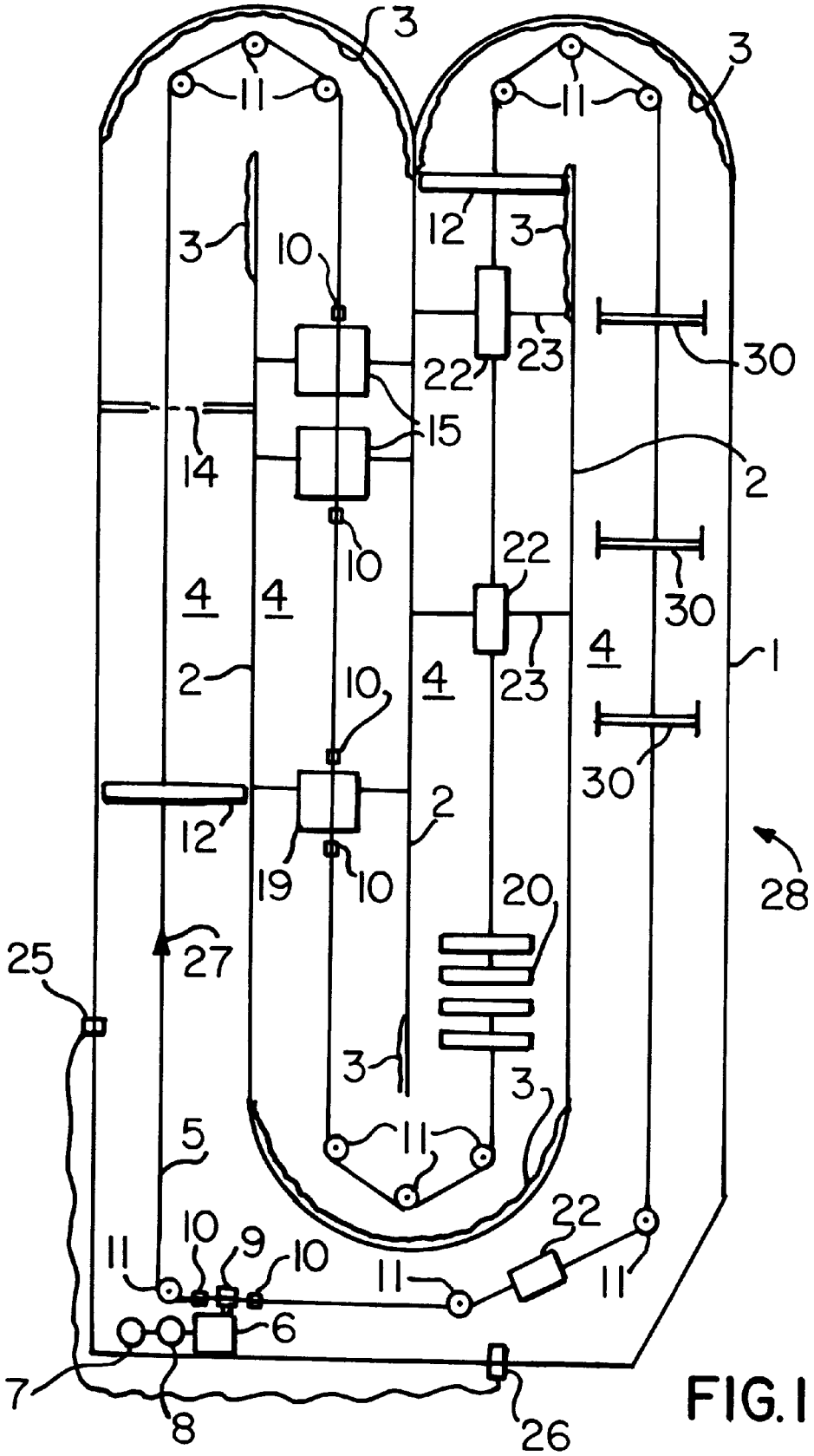
FIG. 1 is a diagrammatic plan view of a course of the invention.
Figure 2:
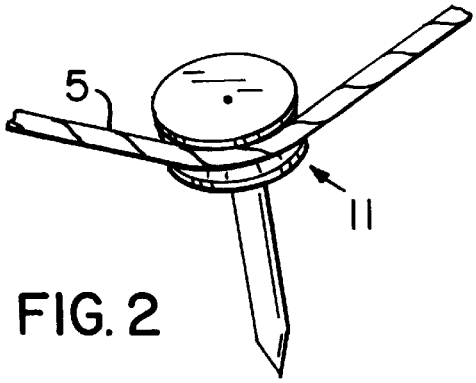
FIG. 2 is a perspective view of a side pulley guide of the invention.
Figure 3:
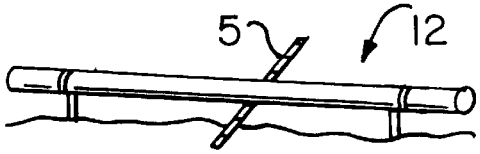
FIG. 3 is a perspective view of a pipe jump of the invention.
Figure 4:
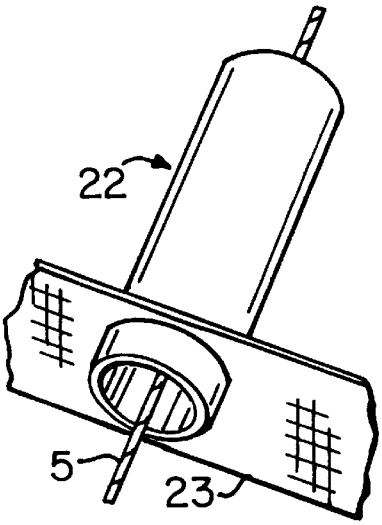
FIG. 4 is a perspective view of a tunnel of the invention.
Figure 5:
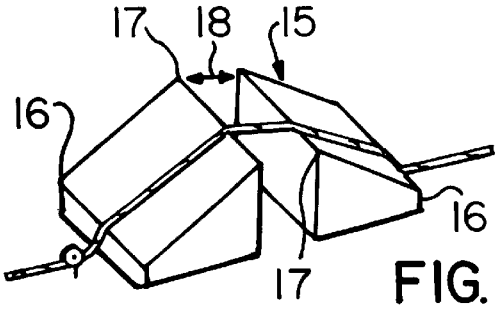
FIG. 5 is a perspective view of a double ramp jump of the invention.
Figure 6:
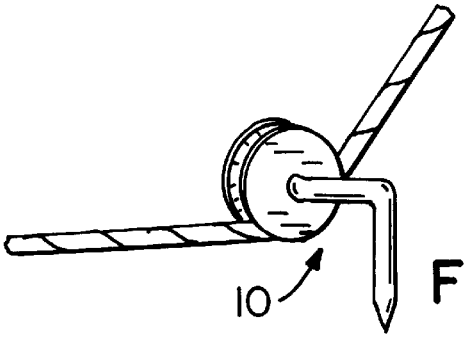
FIG. 6 is a perspective view of a down pulley guide of the invention.
Figure 7:
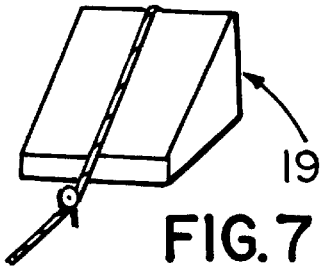
FIG. 7 is a perspective view of a single ramp jump of the invention
Figure 8:
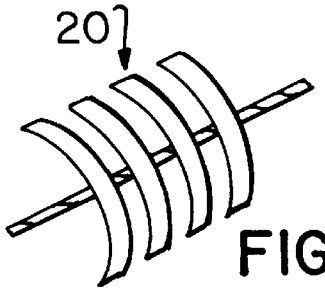
FIG. 8 is a perspective view of a series of arches of the invention.
Figure 9:
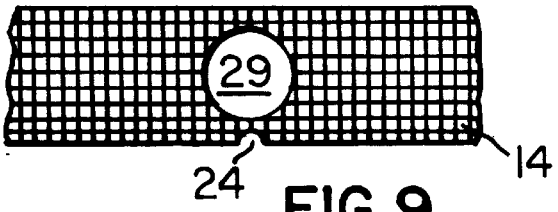
FIG. 9 is a plan view of an apertured screen of the invention.
Figure 10:
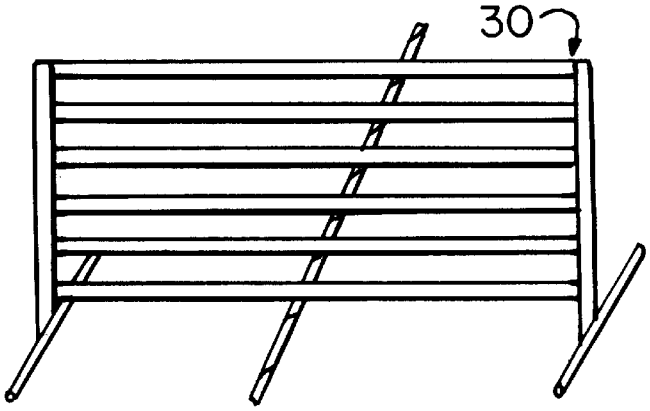
FIG. 10 is a perspective view of a hurdle of the invention.

The invention comprises a competitive performance apparatus for a dog including:

a) a fence enclosed area partitioned into a series of adjacent communicating passages with obscuring curtains mounted on fence and partition to obscure vision as required to avoid distraction of the dog from concentration on the lure;

b) a series of obstacles to be traversed by the dog distributed along the passages;

c) an endless cord loop extending along the passages;

d) motorized driving means operatively connected to the cord loop for driving the cord around the passages;

e) a lure attached to the cord loop for attracting the dog to move along the passages in a correct approach to meet each obstacle squarely;

f) a series of guide means operatively connected to the cord loop for guiding the lure along the passages and so arranged to encourage the dog to properly traverse the obstacles distributed along the passages; and g) the obstacles selected from, but not limited to, the group of obstacles consisting of jumps, tunnels, hurdles, apertured partitions, and constricting arches.

Referring now to the drawings, an area comprising the apparatus 28 is defined by a fence 1, and partitions 2 dividing the area into a plurality of communicating passages 4. An endless cord 5 is guided by a series of down pulleys 10 with horizontal axes and side pulleys 11 with vertical axes around the passages in a continuous loop. A bundle of white plastic strips 27 is attached to the cord to form the dog-attracting lure. A drive pulley 9 drives the lure around the circuit. Down pulleys 10 on either side of the drive pulley maintain tension and bring the cord close to the ground. The drive pulley is driven by motor 6, powered by batteries 7 and controlled by switch 8. Alternatively, power may be supplied by a motor vehicle. A course timer 26, with a start switch 25 indicates the time for running the course. The obstacles ate strategically arranged to increase in difficulty to build confidence and train the animal as it runs. The lure passes beneath the pipe jump 12 that is an 8" pipe held 3" above the ground across the passage. The next obstacle is a screen 14 across the passage with a 20" circular aperture 29 for the animal and a smaller aperture 24 for the cord. Side pulleys 11 turn the cord into the adjacent passage and obscuring curtains 3 maintain the dog's focus on the path taken by the lure. The lure next passes over a double ramp obstacle 15 starting at the low end 16, progressing to the high end 17, and providing a gap 18 of about 2 feet, to be jumped by the dog, to a second high end 17. Down pulleys at both ends of the ramps ensure close contact of the lure with the obstacle. The next obstacle is a single ramp 19 so that the animal must now jump from the elevated end of the ramp to the ground, which is more difficult than a horizontal jump across the gap 18 of the previous jump. Side barriers prevent the dog from running around the ramps. The lure advances to the next passage and passes beneath a series of arches 20 of descending heights. This accustoms the animal to next run through two tunnels 22 that are provided with side screen barriers 23 to prevent the animal from running around the tunnels. Another pipe jump 12 is provided before turning into the final passage. In the final passage the lure passes beneath three hurdles 30 that the animal must jump. They are made of flexible plastic pipe with foam cushioning to avoid injury. A final tunnel 22 slows the dog so that the handler can easily gain control.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts, the configuration of the course, and the specific manner of practicing the invention may be made within the underlying idea or principles of the invention.

What is claimed is:

1. A competitive performance apparatus for a dog comprising:

a) an enclosed area partitioned into a series of communicating passages;

b) a series of obstacles to be traversed by the dog distributed along the passages;

c) an endless cord loop extending along the passages;

d) motorized driving means operatively connected to the cord loop for driving the cord around the passages;

e) a lure attached to the cord loop for attracting the dog to move along the passages; and f) a series of guide means mounted in the passages and operatively connected to the cord loop for guiding the cord, and the lure attached thereto, along the passages and up and down certain said obstacles, and so arranged to encourage the dog to traverse the obstacles distributed along the passages.

2. The apparatus according to claim 1, in which the obstacles are selected from the group of obstacles consisting of jumps, tunnels, hurdles, A frames, teeters, apertured partitions, and constricting arches.

3. The apparatus according to claim 2, in which the communicating passages are provided with vision obscuring means to prevent the dog from straying off course.

4. The apparatus according to claim 1, in which the communicating passages are provided with vision obscuring means to prevent the dog from straying off course.

5. The apparatus according to claim 1, in which the passages are adjacent.

6. A method of performing competitive trials for a dog comprising:

a) providing an enclosed area partitioned into a series of communicating passages;

b) providing a series of obstacles to be traversed by the dog distributed in series along the passages;

c) providing a moving cord and lure attached thereto for attracting the dog to move along the passages, the cord and lure being remotely moved and so guided over, under, and through certain of said obstacles as to encourage the dog to traverse the obstacles;

d) admitting the dog to the enclosed area; and e) moving the lure through the passages to cause the dog to run through the passages and traverse the obstacles in series.

7. The method according to claim 6, further comprising measuring the time the dog takes to run through the passages.

8. The method according to claim 7, in which the obstacles are selected from the group consisting of jumps, tunnels, hurdles, A frames, teeters, apertured partitions, and constricting arches.

9. The method according to claim 6, in which the obstacles are selected from the group consisting of jumps, tunnels, hurdles, A frames, teeters, apertured partitions, and constricting arches.

10. The method according to claim 6, in which the passages are adjacent.

* * * * *